US010890874B2

(12) United States Patent
Nakajima

(10) Patent No.: US 10,890,874 B2
(45) Date of Patent: Jan. 12, 2021

(54) IMAGE FORMING APPARATUS WITH ORIENTATION SETTING MECHANISM FOR USE WITH EXPOSURE UNITS DISPOSED ON APPARATUS COVER

(71) Applicant: Oki Data Corporation, Tokyo (JP)

(72) Inventor: Toru Nakajima, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 16/680,590

(22) Filed: Nov. 12, 2019

(65) Prior Publication Data

US 2020/0209801 A1 Jul. 2, 2020

(30) Foreign Application Priority Data

Dec. 28, 2018 (JP) ..... 2018-246798

(51) Int. Cl.
*G03G 21/16* (2006.01)
*G03G 15/04* (2006.01)

(52) U.S. Cl.
CPC ... *G03G 21/1633* (2013.01); *G03G 15/04036* (2013.01); *G03G 21/1647* (2013.01);
(Continued)

(58) Field of Classification Search
CPC ..... G03G 21/1633; G03G 2221/1687; G03G 21/1647; G03G 21/1666; G03G 21/1671;
(Continued)

(56) References Cited

U.S. PATENT DOCUMENTS

2008/0219696 A1* 9/2008 Itabashi ..... G03G 21/1666 399/114
2009/0087210 A1* 4/2009 Terao ..... G03G 21/1666 399/99

(Continued)

FOREIGN PATENT DOCUMENTS

JP 2007065125 A 3/2007
JP 2011090198 A 5/2011

(Continued)

*Primary Examiner* — Walter L Lindsay, Jr.
*Assistant Examiner* — Laura Roth
(74) *Attorney, Agent, or Firm* — Panitch Schwarze Belisario & Nadel LLP

(57) ABSTRACT

An image forming apparatus includes an apparatus cover, first and second exposure units, and an orientation setting mechanism. The apparatus cover opens or closes by pivoting about a rotation fulcrum with respect to an apparatus body. The first exposure unit is disposed at a first position, on an inner surface, spaced apart from the rotation fulcrum. The second exposure unit is disposed at a second position, on the inner surface, closer than the first position to the rotation fulcrum. The orientation setting mechanism sets an orientation of the first exposure unit to a first direction approaching the apparatus body in a closed state. The orientation setting mechanism sets it to a second direction further away than the first direction from the rotation fulcrum and sets the orientation of the second exposure unit to a third direction between the first and second directions when the opening angle is a first angle.

12 Claims, 15 Drawing Sheets

(52) U.S. Cl.
CPC . *G03G 21/1666* (2013.01); *G03G 2215/0407* (2013.01); *G03G 2221/169* (2013.01); *G03G 2221/1687* (2013.01)

(58) Field of Classification Search
CPC ..... G03G 2215/0407; G03G 21/1619; G03G 15/04036; G03G 2221/169
See application file for complete search history.

(56) References Cited

U.S. PATENT DOCUMENTS

| | | | | |
|---|---|---|---|---|
| 2013/0259517 | A1* | 10/2013 | Mori ..... | G03G 21/1633 399/110 |
| 2013/0315625 | A1* | 11/2013 | Fujita ..... | G03G 21/1628 399/125 |
| 2014/0064781 | A1* | 3/2014 | Hashimoto ..... | G03G 21/1666 399/110 |
| 2018/0095407 | A1* | 4/2018 | Tsukada ..... | G03G 21/1647 |

FOREIGN PATENT DOCUMENTS

| | | | |
|---|---|---|---|
| JP | 2017065125 | A | 4/2017 |
| JP | 2018060037 | A | 4/2018 |

* cited by examiner

IMAGE FORMING APPARATUS WITH ORIENTATION SETTING MECHANISM FOR USE WITH EXPOSURE UNITS DISPOSED ON APPARATUS COVER

CROSS REFERENCE TO RELATED APPLICATIONS

The present application claims priority from Japanese Patent Application No. 2018-246798 filed on Dec. 28, 2018, the entire contents of which are hereby incorporated by reference.

BACKGROUND

The technology relates to an image forming apparatus that forms an image on a recording medium.

In an image forming apparatus, an image is formed in a developing unit through exposure by an exposure unit, for example. In one example of such an image forming apparatus, an exposure unit is provided on an apparatus cover (for example, Japanese Unexamined Patent Application Publication Nos. 2018-60037 and 2007-65125.)

SUMMARY

It is desired that an image forming apparatus be highly user-friendly, and there is an expectation for increased user-friendliness.

It is desirable to provide an image forming apparatus that is able to increase user-friendliness.

According to one embodiment of the technology, there is provided an image forming apparatus that includes an apparatus cover, a first exposure unit, a second exposure unit, and an orientation setting mechanism. The apparatus cover opens or closes by pivoting about a rotation fulcrum with respect to an apparatus body. The apparatus cover includes an inner surface that opposes the apparatus body when the apparatus cover is in a closed state. The first exposure unit is disposed at a first position on the inner surface of the apparatus cover. The first position is spaced apart from the rotation fulcrum. The second exposure unit is disposed at a second position on the inner surface of the apparatus cover. The second position is closer than the first position to the rotation fulcrum. The orientation setting mechanism is provided on the inner surface of the apparatus cover. The orientation setting mechanism sets an orientation of the first exposure unit and an orientation of the second exposure unit in accordance with an opening angle of the apparatus cover. The orientation setting mechanism sets the orientation of the first exposure unit to a first direction approaching the apparatus body when the apparatus cover is in the closed state. The orientation setting mechanism sets the orientation of the first exposure unit to a second direction and sets the orientation of the second exposure unit to a third direction when the apparatus cover is open and the opening angle is a first angle. The second direction is a direction further away than the first direction from the rotation fulcrum. The third direction is a direction between the first direction and the second direction.

DETAILED DESCRIPTION

Figure 1:
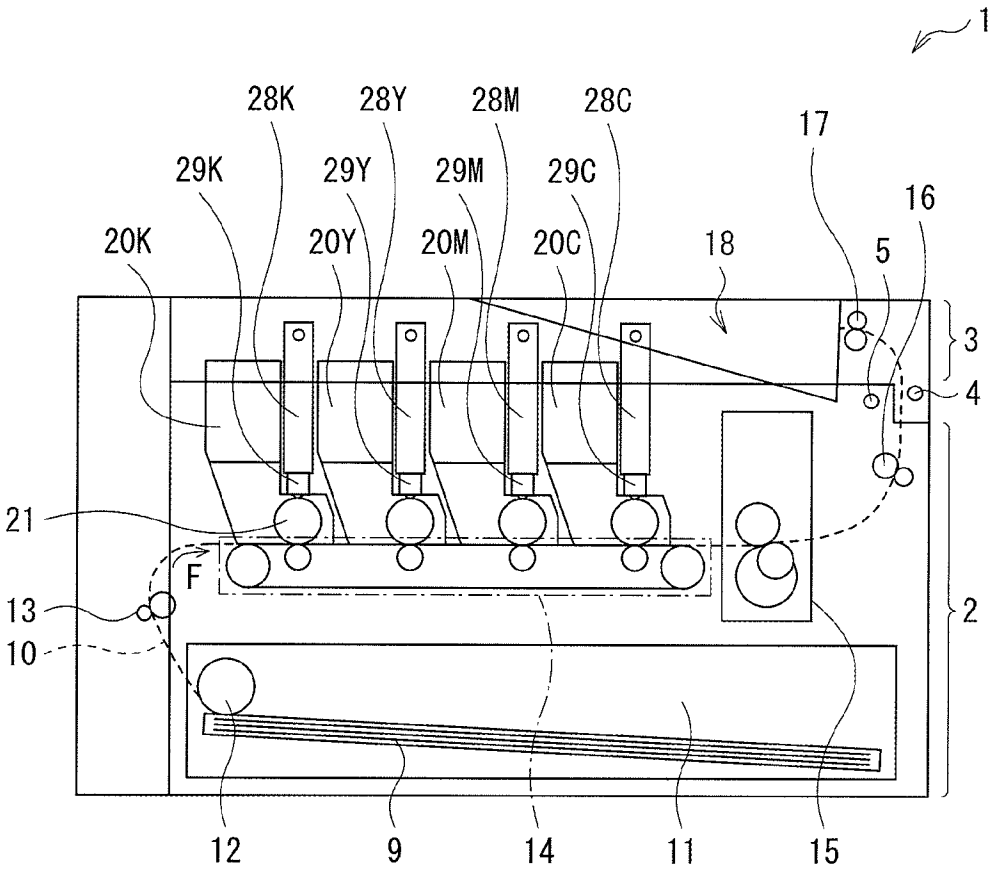
FIG. 1 is an explanatory diagram illustrating one configuration example of an image forming apparatus according to an example embodiment.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

EXAMPLE EMBODIMENTS

Configuration Example

FIG. 1 illustrates one configuration example of an image forming apparatus, i.e., an image forming apparatus 1, according to one example embodiment of the technology. The image forming apparatus 1 may be a printer that forms an image on a recording medium, such as a plain sheet, with the use of an electrophotographic method, for example. The image forming apparatus 1 may include an apparatus body 2 and an apparatus cover 3. The apparatus cover 3 may be a cover for the apparatus body 2. The apparatus cover 3 may be configured to open or close by pivoting about a rotation fulcrum 4.

The image forming apparatus 1 may include a medium storing section 11, a medium feeding roller 12, a registration roller 13, four image drum (ID) units 20, four exposure heads 29, four head holders 28, a transfer section 14, a fixing section 15, a conveyance roller 16, and a discharge roller 17. The ID units 20 may include ID units 20K, 20Y, 20M, and 20C. The exposure heads 29 may include exposure heads 29K, 29Y, 29M, and 29C. The head holders 28 may include head holders 28K, 28Y, 28M, and 28C. The above members may be disposed along a conveyance path 10 through which a recording medium 9 is conveyed. The medium feeding roller 12, the registration roller 13, the four ID units 20, the transfer section 14, the fixing section 15, the conveyance roller 16, and the discharge roller 17 may be provided in the apparatus body 2. The four exposure heads 29 and the four head holders 28 may be provided in the apparatus cover 3.

The medium storing section 11 may store the recording medium 9 on which an image is to be formed.

The medium feeding roller 12 may pick up the recording medium 9 stored in the medium storing section 11, one by one, from the top and send out the picked-up recording medium 9 into the conveyance path 10.

The registration roller 13 may include a pair of rollers disposed with the conveyance path 10 interposed therebetween. The registration roller 13 may correct a skew of the recording medium 9 conveyed by the medium feeding roller 12 and convey the recording medium 9 along the conveyance path 10.

The four ID units 20 may each form a toner image. For example, the ID unit 20K may form a black (K) toner image, the ID unit 20Y may form a yellow (Y) toner image, the ID unit 20M may form a magenta (M) toner image, and the ID unit 20C may form a cyan (C) toner image. In this example, the four ID units 20 may be disposed in the order of the ID units 20K, 20Y, 20M, and 20C in a conveyance direction F of the recording medium 9. The ID units 20 may each be configured to be attachable to and detachable from the image forming apparatus 1. The user may be able to replace the ID units 20 upon opening the apparatus cover 3, for example.

The ID units 20 may each include a photosensitive drum 21. In this example, each photosensitive drum 21 may rotate counterclockwise with motive power transmitted from an unillustrated drum motor. In each of the ID units 20, the photosensitive drum 21 may be exposed by the exposure head 29, and an electrostatic latent image may be thereby formed on a surface of the photosensitive drum 21. Thereafter, a toner may be fed to the photosensitive drum 21, and a toner image corresponding to the electrostatic latent image may be thereby formed on the surface of the photosensitive drum 21.

The four exposure heads 29 may each irradiate, with light, the photosensitive drum 21 in the corresponding one of the ID units 20. For example, the exposure head 29K may irradiate the photosensitive drum 21 in the ID unit 20K with light, the exposure head 29Y may irradiate the photosensitive drum 21 in the ID unit 20Y with light, the exposure head 29M may irradiate the photosensitive drum 21 in the ID unit 20M with light, and the exposure head 29C may irradiate the photosensitive drum 21 in the ID unit 20C with light. The exposure heads 29 may each include, for example, a plurality of light-emitting diodes disposed side by side in a main scanning direction, i.e., a depthwise direction in FIG. 1. The exposure heads 29 may each irradiate the photosensitive drum 21 with light on a dot-by-dot basis with the use of the light-emitting diodes. Thus, the photosensitive drums 21 may each be subjected to exposure by the corresponding one of the exposure heads 29, and an electrostatic latent image may be formed on the surface of each photosensitive drum 21.

The four head holders 28 may each hold the corresponding one of the exposure heads 29. For example, the head holder 28K may hold the exposure head 29K, the head holder 28Y may hold the exposure head 29Y, the head holder 28M may hold the exposure head 29M, and the head holder 28C may hold the exposure head 29C. The head holders 28 may each be supported by the apparatus cover 3.

The transfer section 14 may transfer the four toner images formed by the respective ID units 20 onto a transfer target surface of the recording medium 9.

The fixing section 15 may apply heat and pressure to the recording medium 9 and thereby fix, to the recording medium 9, the toner images transferred onto the recording medium 9. The user may be able to replace the fixing section 15 upon opening the apparatus cover 3, for example.

The conveyance roller 16 may include a pair of rollers disposed with the conveyance path 10 interposed therebetween. The conveyance roller 16 may convey the recording medium 9 toward the discharge roller 17 along the conveyance path 10.

The discharge roller 17 may include a pair of rollers disposed with the conveyance path 10 interposed therebetween. The discharge roller 17 may convey, toward a discharge tray 18, the recording medium 9 conveyed by the conveyance roller 16.

Figure 2:
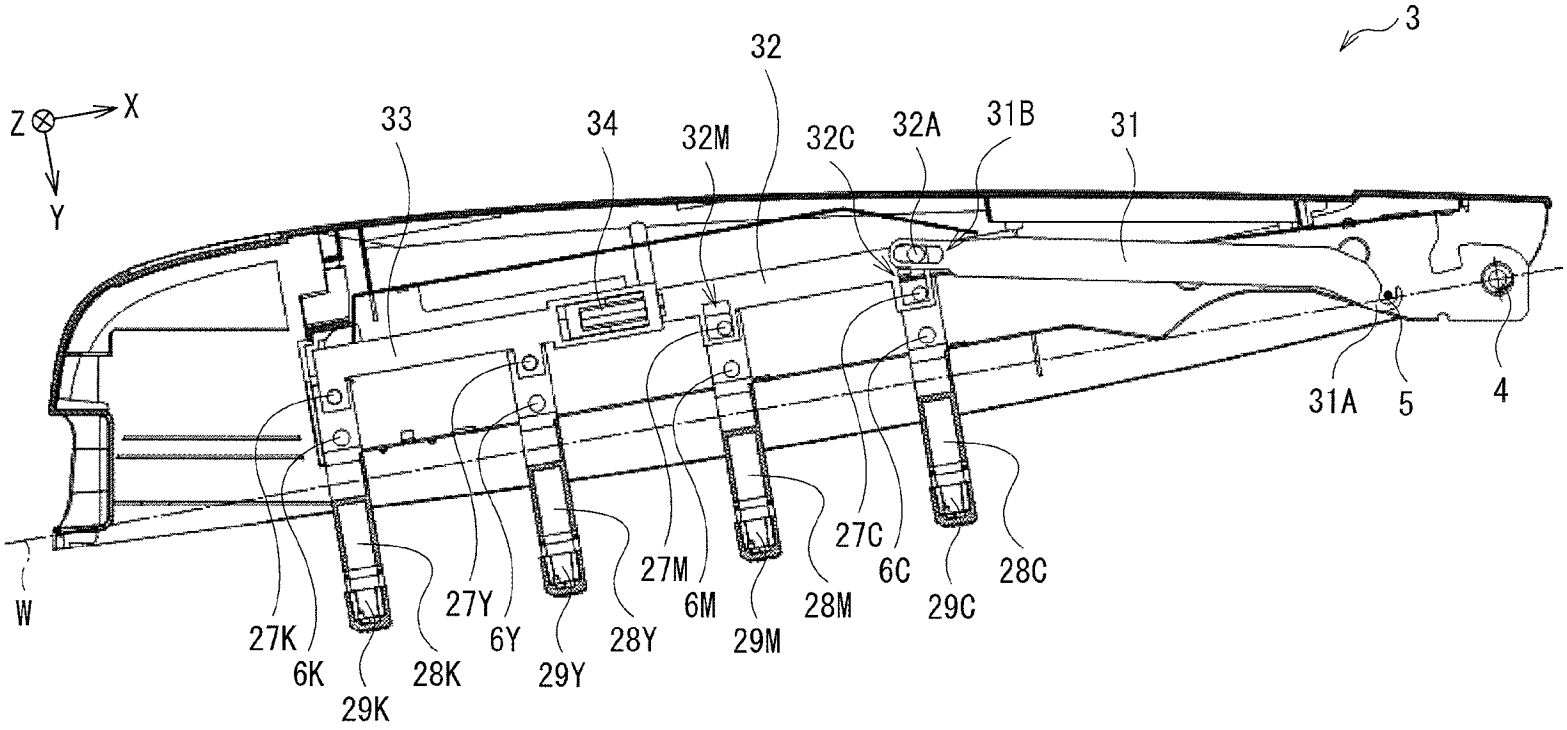
FIG. 2 is a structural diagram illustrating one configuration example of an apparatus cover illustrated in FIG. 1.

FIG. 2 illustrates one configuration example of the apparatus cover 3. The apparatus cover 3 may be configured to open or close in a vertical direction by pivoting about the rotation fulcrum 4, for example. The rotation fulcrum 4 may include a shaft, for example. For example, a direction in which the shaft extends may be an axial direction, and a direction in which the apparatus cover 3 opens relative to the shaft may be a radial direction. The apparatus cover 3 may be locked by an unillustrated lock mechanism while the apparatus cover 3 is in a closed state and allowed to open upon the lock having been released.

The apparatus cover 3 may include the four head holders 28, the four exposure heads 29, a link member 31, coupling members 32 and 33, and a spring 34.

The four head holders 28 may be so supported as to be pivotable about respective rotation fulcrums 6. For example, the head holder 28K may be so supported as to be pivotable about a rotation fulcrum 6K, the head holder 28Y may be so supported as to be pivotable about a rotation fulcrum 6Y, the head holder 28M may be so supported as to be pivotable about a rotation fulcrum 6M, and the head holder 28C may be so supported as to be pivotable about a rotation fulcrum 6C. Further, the four head holders 28 may each include a pin 27. For example, the head holder 28K may include a pin 27K, the head holder 28Y may include a pin 27Y, the head holder 28M may include a pin 27M, and the head holder 28C may include a pin 27C. As will be described later, the pin 27K of the head holder 28K and the pin 27Y of the head holder 28Y may engage with the coupling member 33, and the pin 27M of the head holder 28M and the pin 27C of the head holder 28C may engage with the coupling member 32.

The four exposure heads 29 may be held by the respective head holders 28. The exposure heads 29K, 29Y, 29M, and 29C may be disposed in this order in the X-direction indicated in FIG. 2. As will be described later, an X-direction may be a direction in which the coupling members 32 and 33 are allowed to slide. The X-direction may also be a direction that intersects the rotation fulcrum 4 and approaches the rotation fulcrum 4.

The link member 31 may be configured to allow the coupling member 32 to slide and move in accordance with an opening angle θ of the apparatus cover 3. The opening angle θ is an angle from an angle of the apparatus cover 3 in the closed state as a reference. The link member 31 may include a hook-shaped portion 31A and have a hole portion 31B. The hook-shaped portion 31A may be provided at a first end of the link member 31. The hook-shaped portion 31A may be configured to engage with an unillustrated pin provided on inner side of the apparatus body 2. This configuration may allow the link member 31 to pivot about an auxiliary rotation fulcrum 5 corresponding to the aforementioned pin. FIG. 2 illustrates a line W connecting the rotation fulcrum 4 and the auxiliary rotation fulcrum 5. The hole portion 31B may be provided at a second end of the link member 31. The hole portion 31B may be configured to engage with a pin, i.e., a pin 32A, provided in the coupling member 32. The hole portion 31B may be greater in size than the pin 32A. In a specific but non-limiting example, the hole portion 31B may be longer in a direction in which the link member 31 extends. This configuration may allow the pin 32A to move within the hole portion 31B by an amount corresponding to the size of the hole portion 31B in the direction in which the link member 31 extends. With this configuration, since the hook-shaped portion 31A provided at the first end of the link member 31 engages with the auxiliary rotation fulcrum 5, an increase in the opening angle θ of the apparatus cover 3 may cause a change in a relative positional relationship between the hole portion 31B and the pin 32A in the link member 31. In a specific but non-limiting example, the position of the pin 32A in the hole portion 31B may move in a direction opposite to the X-direction. Upon the opening angle θ having reached a certain angle, an edge of the hole portion 31B may come into contact with the pin 32A, and force may thereby act on the pin 32A in the X-direction, causing the coupling member 32 to move in the X-direction as a result.

The coupling member 32 may be coupled to the link member 31 and coupled to the coupling member 33 with the spring 34 interposed therebetween. The coupling member 32 may be slidable and movable in the X-direction. The coupling member 32 may include the pin 32A and have hole portions 32M and 32C. The pin 32A may engage with the hole portion 31B of the link member 31. The hole portion 32M may engage with the pin 27M of the head holder 28M. The hole portion 32M may be greater in size than the pin 27M. In this example, the hole portion 32M may have a rectangular shape. This configuration may allow the pin 27M to move within the hole portion 32M by an amount corresponding to the size of the hole portion 32M. The hole portion 32C may engage with the pin 27C of the head holder 28C. The hole portion 32C may be greater in size than the pin 27C. In this example, the hole portion 32C may have a rectangular shape. This configuration may allow the pin 27C to move within the hole portion 32C by an amount corresponding to the size of the hole portion 32C. With this configuration, as the coupling member 32 slides and moves in the X-direction and as an edge of the hole portion 32M comes into contact with the pin 27M of the head holder 28M, force may act on the pin 27M in the X-direction. Further, as an edge of the hole portion 32C comes into contact with the pin 27C of the head holder 28C, force may act on the pin 27C in the X-direction. Thus, the head holder 28M may pivot about the rotation fulcrum 6M, and the head holder 28C may pivot about the rotation fulcrum 6C. As a result, the apparatus cover 3 may allow the orientation of the exposure heads 29M and 29C to vary.

The spring 34 may be configured to transmit force from the coupling member 32 to the coupling member 33. In a specific but non-limiting example, when the coupling member 32 slides and moves in the X-direction, the spring 34 may transmit this force to the coupling member 33, and the coupling member 33 may slide and move in the X-direction, as with the coupling member 32. Further, in a case where the coupling member 33 has moved to an end portion of a movable range in the X-direction and has become unable to move any further in the X-direction, since the coupling member 33 is unable to move in the X-direction although the coupling member 32 is able to move in the X-direction, the spring 34 may be compressed to absorb displacement of the coupling member 32 in the X-direction. In this example, although a compression spring may be used, this is non-limiting. Alternatively, a tension spring may be used, or any other elastic member may be used.

The coupling member 33 may be coupled to the coupling member 32 with the spring 34 interposed therebetween. As with the coupling member 32, the coupling member 33 may be configured to be slidable and movable in the X-direction. The coupling member 33 may engage with the pin 27K of the head holder 28K and with the pin 27Y of the head holder 28Y. With this configuration, in a case where the coupling member 33 moves in the X-direction, force may act in the X-direction on the pin 27K of the head holder 28K and the pin 27Y of the head holder 28Y. Thereby, the head holder 28K may pivot about the rotation fulcrum 6K, and the head holder 28Y may pivot about the rotation fulcrum 6Y. As a result, the apparatus cover 3 may allow the orientation of the exposure heads 29K and 29Y to vary.

With the configuration described above, in the image forming apparatus 1, as the user releases the lock by operating the lock mechanism and lifts the apparatus cover 3, the apparatus cover 3 may pivot about the rotation fulcrum 4, and the orientation of the exposure heads 29K, 29Y, 29M, and 29C may vary in accordance with the opening angle θ of the apparatus cover 3. Accordingly, as will be described later, the image forming apparatus 1 may allow the user to perform more easily an operation such as maintenance of the exposure heads 29 or replacement of the fixing section 15, for example.

The rotation fulcrum 4 may correspond to a "rotation fulcrum" in one specific but non-limiting embodiment of the technology. The exposure head 29K may correspond to a "first exposure unit" in one specific but non-limiting embodiment of the technology. The exposure head 29C may correspond to a "second exposure unit" in one specific but non-limiting embodiment of the technology. The exposure heads 29Y and 29M may correspond to a "third exposure unit" in one specific but non-limiting embodiment of the technology. The link member 31, the coupling members 32 and 33, the spring 34, and the four head holders 28 may correspond to an "orientation setting mechanism" in one specific but non-limiting embodiment of the technology. The link member 31 may correspond to a "first member" in one specific but non-limiting embodiment of the technology. The coupling member 32 may correspond to a "second member" in one specific but non-limiting embodiment of the technology. The spring 34 may correspond to an "elastic member" in one specific but non-limiting embodiment of the technology. The coupling member 33 may correspond to a "third member" in one specific but non-limiting embodiment of the technology. The head holder 28K may correspond to a "first holding portion" in one specific but non-limiting embodiment of the technology. The pin 27K may correspond to a "first projection portion" in one specific but non-limiting embodiment of the technology. The head holder 28C may correspond to a "second holding portion" in one specific but non-limiting embodiment of the technology. The pin 27C may correspond to a "second projection portion" in one specific but non-limiting embodiment of the technology. The hole portion 32C may correspond to a "hole portion" in one specific but non-limiting embodiment of the technology. The auxiliary rotation fulcrum 5 may correspond to an "auxiliary rotation fulcrum" in one specific but non-limiting embodiment of the technology.

Example Operations and Example Workings

Example operations and example workings of the image forming apparatus 1 according to the present example embodiment will now be described.

[Overview of Overall Operation]

First, an overview of an overall operation of the image forming apparatus 1 will be described with reference to FIG. 1. The medium feeding roller 12 may pick up the recording medium 9 stored in the medium storing section 11, one by one, from the top and send out the picked-up recording medium 9 into the conveyance path 10. The registration roller 13 may correct a skew of the recording medium 9 and convey the recording medium 9 along the conveyance path 10. With this operation, the recording medium 9 may be conveyed to the four ID units 20. In each of the four ID units 20, the photosensitive drum 21 may be subjected to exposure by the corresponding one of the exposure heads 29, and an electrostatic latent image may be thereby formed on the surface of the photosensitive drum 21. Thereafter, a toner may be fed to the photosensitive drum 21, and a toner image corresponding to the electrostatic latent image may be thereby formed on the photosensitive drum 21. The transfer section 14 may transfer the four toner images formed by the respective ID units 20 onto the transfer target surface of the recording medium 9. Thereafter, the fixing section 15 may apply heat and pressure to the recording medium 9 and thereby fix, to the recording medium 9, the toner images transferred onto the recording medium 9. The conveyance roller 16 may convey the recording medium 9 toward the discharge roller 17 along the conveyance path 10. The discharge roller 17 may convey, toward the discharge tray 18, the recording medium 9 conveyed by the conveyance roller 16.

[Opening-closing Operation of Apparatus Cover 3]

Now, an operation of the apparatus cover 3 performed when the user opens the apparatus cover 3 will be described in detail.

Figure 3A:
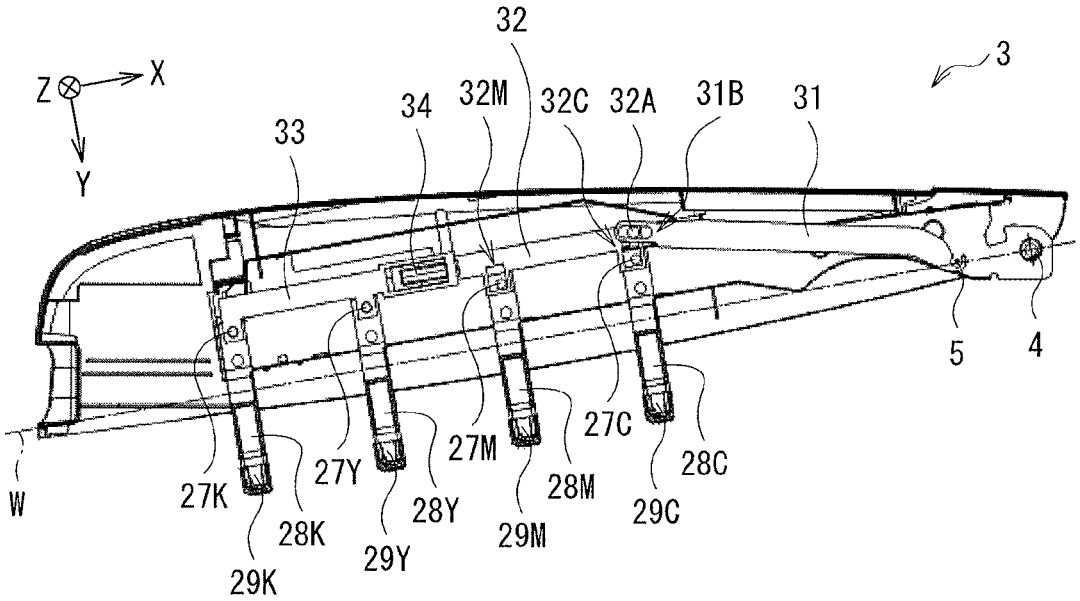
FIG. 3A is an explanatory diagram illustrating one operation example of an apparatus cover illustrated in FIG. 2.
Figure 3B:
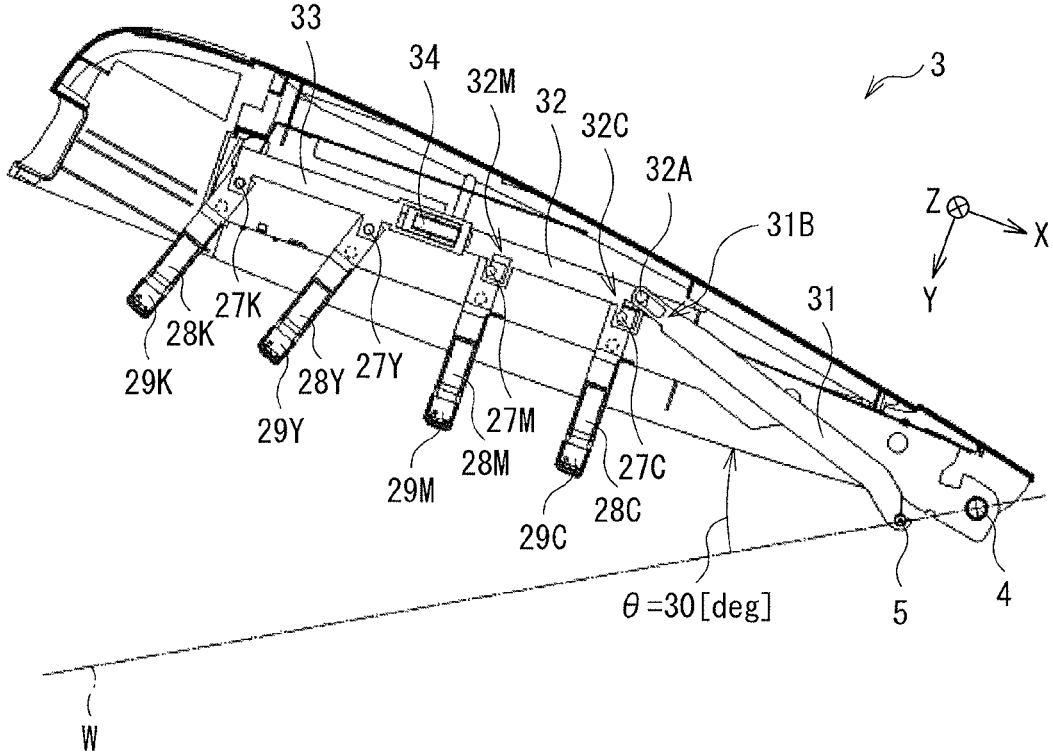
FIG. 3B is another explanatory diagram illustrating one operation example of the apparatus cover illustrated in FIG. 2.
Figure 3C:
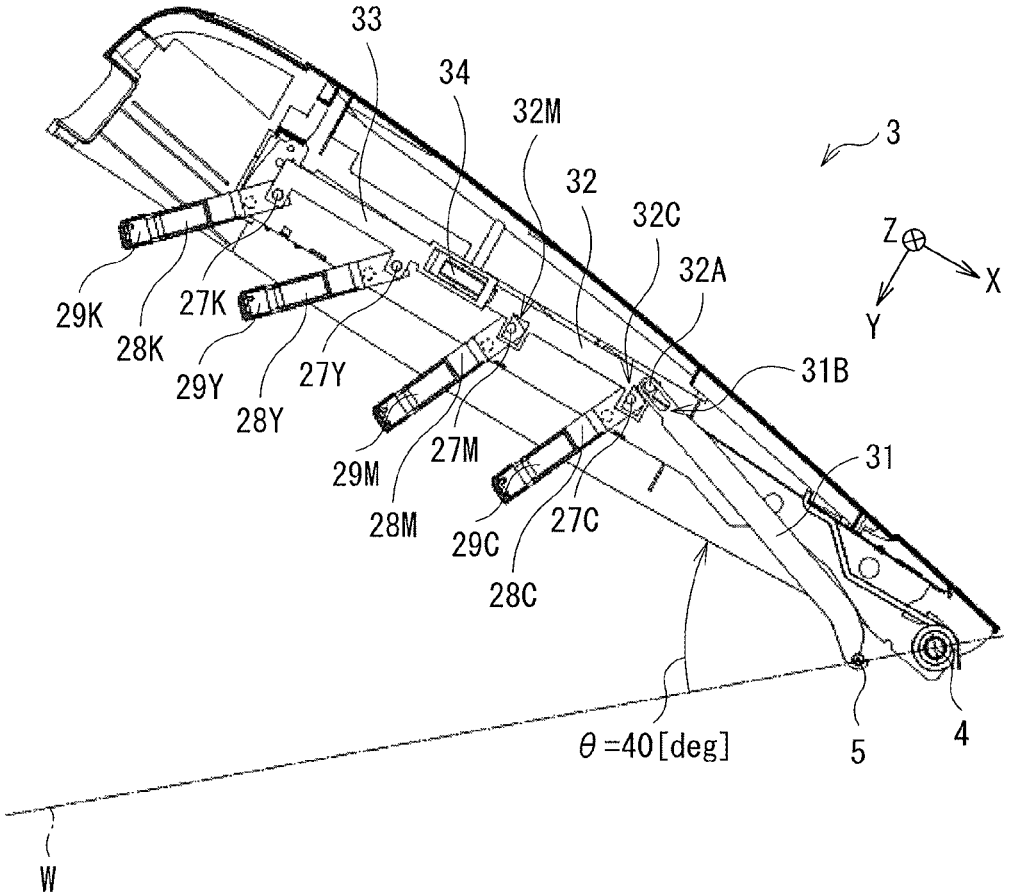
FIG. 3C is still another explanatory diagram illustrating one operation example of the apparatus cover illustrated in FIG. 2.
Figure 3D:
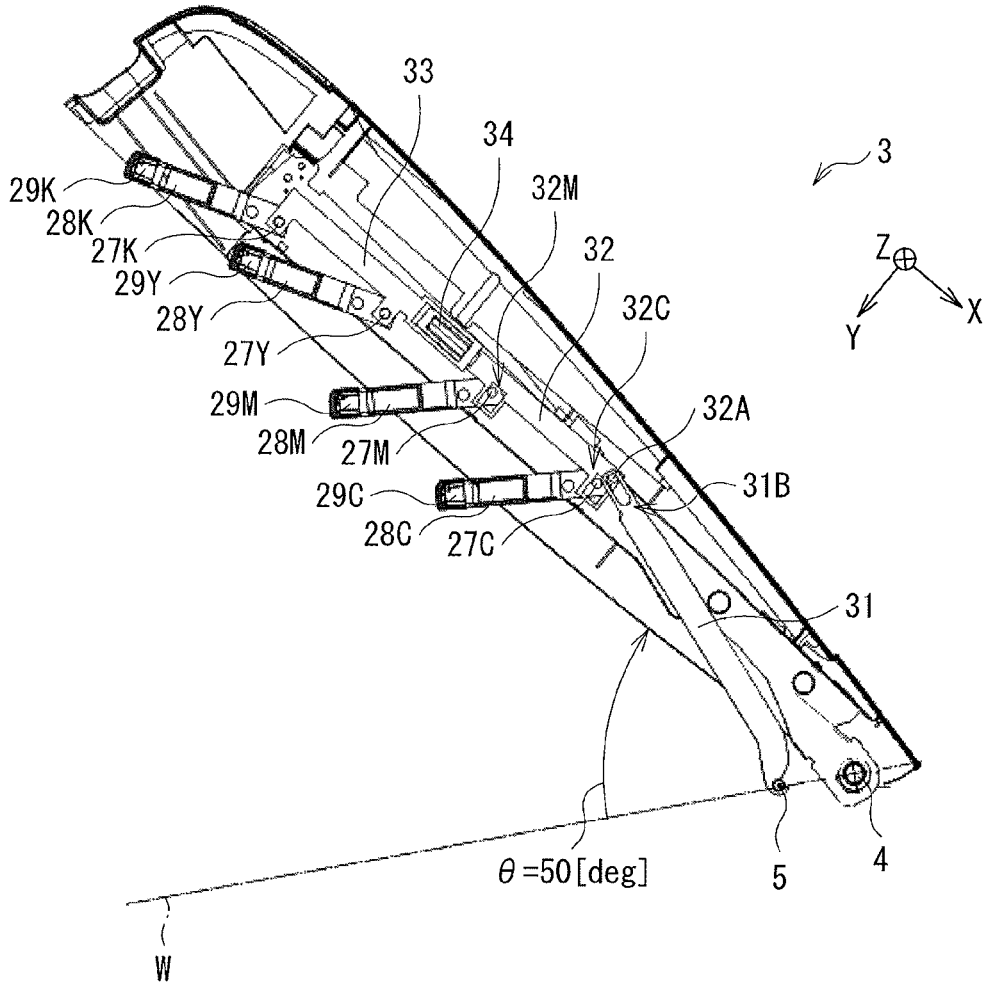
FIG. 3D is still another explanatory diagram illustrating one operation example of the apparatus cover illustrated in FIG. 2.
Figure 3E:
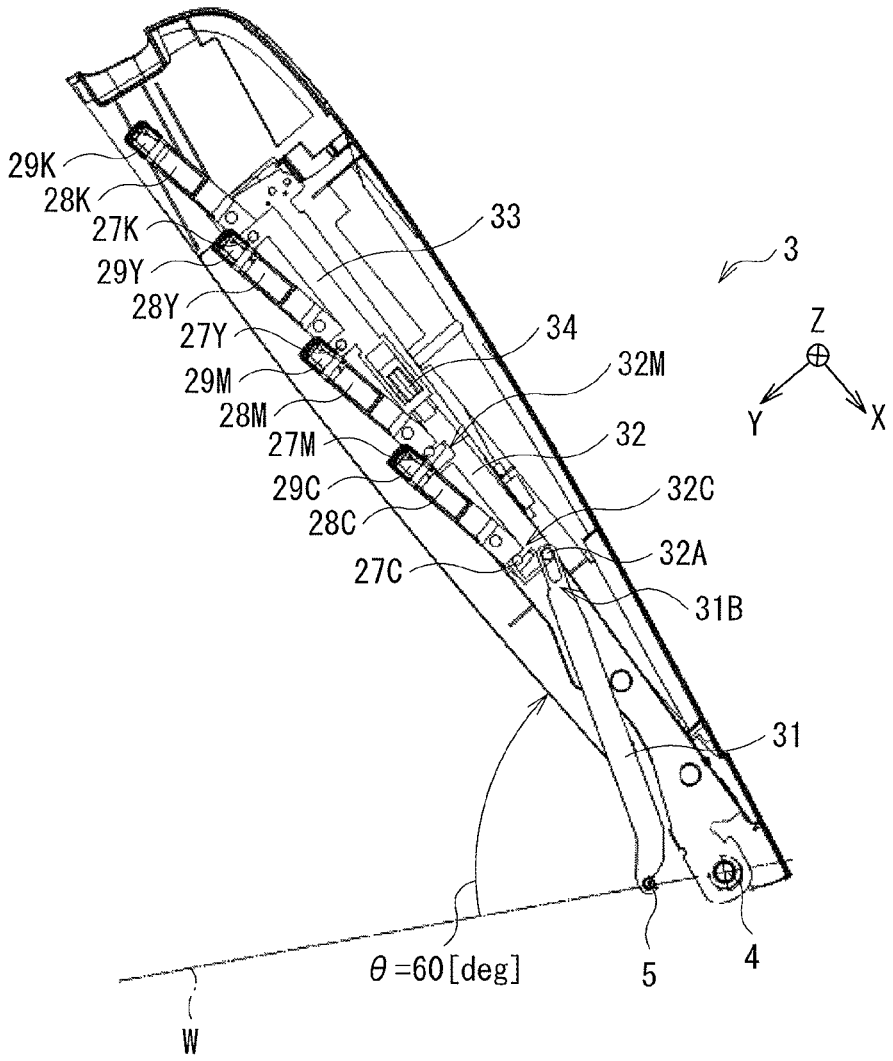
FIG. 3E is still another explanatory diagram illustrating one operation example of the apparatus cover illustrated in FIG. 2.

FIGS. 3A to 3E illustrate one operation example of the apparatus cover 3. FIG. 3A illustrates a case where the opening angle θ is 0 (zero) degrees. FIG. 3B illustrates a case where the opening angle θ is 30 degrees. FIG. 3C illustrates a case where the opening angle θ is 40 degrees. FIG. 3D illustrates a case where the opening angle θ is 50 degrees. FIG. 3E illustrates a case where the opening angle θ is 60 degrees.

[Case Where Opening Angle θ is 0 (Zero) Degrees]

In the case where the opening angle θ is 0 (zero) degrees illustrated in FIG. 3A, in this example, the pin 32A of the coupling member 32 may be positioned near the middle of the hole portion 31B of the link member 31. Further, the pin 27M of the head holder 28M may be positioned in a right region in the hole portion 32M of the coupling member 32. In a similar manner, the pin 27C of the head holder 28C may be positioned in a right region in the hole portion 32C of the coupling member 32. In other words, in the case where the opening angle θ is 0 (zero) degrees, the pin 27M may be in contact with a right edge of the hole portion 32M, and the pin 27C may be in contact with the right edge of the hole portion 32C. Direction of the longitudinal axes of the head holders 28M and 28C may be oriented downward due to the head holders' own weight. However, since the pin 27M is in contact with the right edge of the hole portion 32M and since the pin 27C is in contact with the right edge of the hole portion 32C in the above-described manner, the orientation of the head holders 28M and 28C may be regulated and set slightly to the right relative to the downward direction, and the head holders 28M and 28C may be oriented in a direction, e.g., the Y-direction, substantially orthogonal to the direction in which the coupling member 32 extends, i.e., the X-direction. In this manner, the orientation of the exposure heads 29M and 29C may also be brought to the direction substantially orthogonal to the direction in which the coupling member 32 extends.

In the case where the opening angle θ is 0 (zero) degrees, the spring 34 may be in a state of being most stretched. As with the head holders 28M and 28C, the direction of the longitudinal axes of the head holders 28K and 28Y may become oriented in the direction, e.g., the Y-direction, substantially orthogonal to the direction in which the coupling member 33 extends, i.e., the X-direction. In this manner, the orientation of the exposure heads 29K and 29Y may also be brought to the direction substantially orthogonal to the direction in which the coupling member 33 extends.

In this manner, the orientation of each of the four exposure heads 29K, 29Y, 29M, and 29C may be brought to the direction substantially orthogonal to the direction in which the coupling member 32 extends. This may cause light-irradiating surfaces of the four exposure heads 29K, 29Y, 29M, and 29C to oppose the respective photosensitive drums 21 in the ID units 20K, 20Y, 20M, and 20C as illustrated in FIG. 1, allowing the photosensitive drums 21 to be subjected to exposure by the respective exposure heads 29.

When the user releases the lock by operating the lock mechanism, the apparatus cover 3 may become openable. As the user lifts the apparatus cover 3, the apparatus cover 3 may pivot about the rotation fulcrum 4. In this manner, the apparatus cover 3 may open, and the opening angle θ may thereby increase.

[Case Where Opening Angle θ is 30 Degrees]

In the case where the opening angle θ is 30 degrees illustrated in FIG. 3B, the pin 32A of the coupling member 32 may be in contact with a left edge of the hole portion 31B of the link member 31. In other words, as the apparatus cover 3 is gradually opened to vary the opening angle θ from 0 (zero) degrees to 30 degrees, the position of the pin 32A in the hole portion 31B may gradually move from a position near the middle of the hole portion 31B in the direction opposite to the X-direction, and the pin 32A may come into contact with the left edge of the hole portion 31B. At this point, the link member 31 may be inclined in accordance with the variation in the opening angle θ. In the image forming apparatus 1, the hole portion 31B of the link member 31 may be greater in size than the pin 32A. Therefore, inclination of the link member 31 may not have any influence on the coupling member 32. Further, as the left edge of the hole portion 31B comes into contact with the pin 32A, force may act on the pin 32A in the X-direction. As a result, the coupling member 32 may slide and move in the X-direction.

Since the coupling member 32 moves in the X-direction in this manner, the pin 27M of the head holder 28M may be positioned in left region in the hole portion 32M of the coupling member 32. In a similar manner, the pin 27C of the head holder 28C may be positioned in a left region in the hole portion 32C of the coupling member 32. In other words, in the case where the opening angle θ is 30 degrees, the left edge of the hole portion 32M may be in contact with the pin 27M, and the left edge of the hole portion 32C may be in contact with the pin 27C. Therefore, force may act on the pins 27M and 27C in the X-direction. This may cause the head holder 28M to pivot clockwise about the rotation fulcrum 6M illustrated in FIG. 2, and cause the head holder 28C to pivot clockwise about the rotation fulcrum 6C. The direction of the longitudinal axes of the head holders 28M and 28C may be oriented downward due to the head holders' own weight. However, since the pin 27M is in contact with the left edge of the hole portion 32M and since the pin 27C is in contact with the left edge of the hole portion 32C in the above-described manner, the orientation of the head holders 28M and 28C may be regulated, and the head holders 28M and 28C may be oriented in the direction, e.g., the Y-direction, substantially orthogonal to the direction in which the coupling member 32 extends, i.e., the X-direction. In this manner, the orientation of the exposure heads 29M and 29C may also be brought to the direction substantially orthogonal to the direction in which the coupling member 32 extends.

In this manner, as the coupling member 32 moves in the X-direction, the coupling member 33 may also slide and move in the X-direction in a similar manner. This may cause the head holder 28K to pivot clockwise about the rotation fulcrum 6K illustrated in FIG. 2, and cause the head holder 28Y to pivot clockwise about the rotation fulcrum 6Y. Further, the orientation of the head holders 28K and 28Y may be shifted from the Y-direction and come to a direction slightly away from the rotation fulcrum 4. In this manner, the orientation of the exposure heads 29K and 29Y may also be brought to the direction slightly away from the rotation fulcrum 4.

In this manner, in the image forming apparatus 1, the hole portion 32M of the coupling member 32 may be greater in size than the pin 27M, and the hole portion 32C of the coupling member 32 may be greater in size than the pin 27C. Therefore, as illustrated in FIG. 3B, the orientation of the exposure heads 29M and 29C and the orientation of the exposure heads 29K and 29Y may become different from each other.

[Case Where Opening Angle θ is 40 Degrees]

In the case where the opening angle θ is 40 degrees illustrated in FIG. 3C, the coupling member 32 may further slide and move in the X-direction than in the case where the opening angle θ is 30 degrees illustrated in FIG. 3B. This may cause the orientation of the head holders 28M and 28C to be shifted from the Y-direction and come to a direction slightly away from the rotation fulcrum 4. Further, the coupling member 33 may also further slide and move in the X-direction in accordance with the movement of the coupling member 32. Therefore, the orientation of the head holders 28K and 28Y may be further shifted from the Y-direction and come to a direction further away from the rotation fulcrum 4.

In the case where the opening angle θ is 40 degrees, as illustrated in FIG. 3C, the head holders 28K and 28Y may be oriented substantially laterally, and a space may be thereby secured near the light-irradiating surfaces of the exposure heads 29K and 29Y. Accordingly, the user may be able to more easily perform an operation such as checking any flaw or stain on the exposure heads 29K and 29Y or cleaning the exposure heads 29K and 29Y, for example.

[Case Where Opening Angle θ is 50 Degrees]

In the case where the opening angle θ is 50 degrees illustrated in FIG. 3D, the coupling member 32 may further slide and move in the X-direction than in the case where the opening angle θ is 40 degrees illustrated in FIG. 3C. This may cause the orientation of the head holders 28M and 28C to be further shifted from the Y-direction and come to a direction further away from the rotation fulcrum 4. Further, the coupling member 33 may also further slide and move in the X-direction in accordance with the movement of the coupling member 32. Therefore, the orientation of the head holders 28K and 28Y may be further shifted from the Y-direction and come to a direction further away from the rotation fulcrum 4. As a result, the exposure heads 29K and 29Y may be substantially contained within the apparatus cover 3. In other words, the exposure heads 29K and 29Y may be retracted into the apparatus cover 3.

In the case where the opening angle θ is 50 degrees, as illustrated in FIG. 3D, the head holders 28M and 28C may be oriented substantially laterally, and a space may be thereby secured near the light-irradiating surfaces of the respective exposure heads 29M and 29C. This may allow the user to more easily perform an operation such as checking any flaw or stain on the exposure heads 29M and 29C or cleaning the exposure heads 29M and 29C. Meanwhile, since the exposure heads 29K and 29Y are substantially contained within the apparatus cover 3, it is possible to reduce a possibility that the exposure heads 29K and 29Y interfere with the user operation.

[Case Where Opening Angle θ is 60 Degrees]

In the case where the opening angle θ is 60 degrees illustrated in FIG. 3E, the coupling member 32 may further slide and move in the X-direction than in the case where the opening angle θ is 50 degrees illustrated in FIG. 3D. This may cause the orientation of the head holders 28M and 28C to be further shifted from the Y-direction and come to the direction further away from the rotation fulcrum 4. As a result, the exposure heads 29M and 29C may be substantially contained within the apparatus cover 3.

As the coupling member 32 moves in the X-direction, the coupling member 33 may also slide and move in the X-direction in a similar manner. In this example, however, the coupling member 33 may have already moved to the end portion of the movable range and may not be able to move any further in the X-direction. In this case, the coupling member 32 may move in the X-direction, but the coupling member 33 may not move. Therefore, the spring 34 may be compressed. In other words, displacement of the coupling member 32 in the X-direction may be absorbed by the spring 34. This may cause the orientation of the head holders 28M and 28C that engage with the coupling member 32 to vary, but may substantially retain the orientation of the head holders 28K and 28Y that engage with the coupling member 33. In this manner, the exposure heads 29K and 29Y may remain in a state of being contained within the apparatus cover 3.

In the case where the opening angle θ is 60 degrees, as illustrated in FIG. 3E, the exposure heads 29K, 29Y, 29M, and 29C may be contained within the apparatus cover 3. This makes it possible to secure a space above the fixing section 15 and the ID units 20 in the image forming apparatus 1. The user may thereby be able to more easily perform an operation such as replacement of the fixing section 15 or replacement of the ID units 20, for example.

In this manner, in the image forming apparatus 1, since the orientations of the respective four exposure heads 29 are set in accordance with the opening angle θ of the apparatus cover 3, it is possible to facilitate an operation such as maintenance of the exposure heads 29 or replacement of the fixing section 15.

For example, in the image forming apparatus 1, in the case where the opening angle θ is 40 degrees, the exposure heads 29K and 29Y may be oriented substantially laterally, as illustrated in FIG. 3C. This may allow the user to more easily perform an operation such as checking any flaw or stain on the exposure heads 29K and 29Y or cleaning the exposure heads 29K and 29Y.

Further, in the image forming apparatus 1, in the case where the opening angle θ is 50 degrees, for example, the orientation of the exposure heads 29K and 29Y may be so set as to allow the exposure heads 29K and 29Y to be substantially contained within the apparatus cover 3, and the exposure heads 29M and 29C may be oriented substantially laterally, as illustrated in FIG. 3D. This allows the user to more easily perform an operation such as checking any flaw or stain on the exposure heads 29M and 29C or cleaning the exposure heads 29M and 29C without the exposure heads 29K and 29Y interfering with the user operation, for example. In this example, the exposure heads 29K and 29Y may be substantially contained within the apparatus cover 3. Therefore, it is possible to reduce a possibility that the user comes into contact with the exposure heads 29K and 29Y and to reduce a possibility that the exposure heads 29K and 29Y are damaged.

Further, in the image forming apparatus 1, in the case where the opening angle θ is 60 degrees, for example, the orientation of each of the four exposure heads 29 may be so set as to allow the four exposure heads 29 to be contained within the apparatus cover 3, as illustrated in FIG. 3E. This makes it possible to secure a space above the fixing section 15 and the ID units 20 in the image forming apparatus 1. The user may be thereby able to more easily perform an operation such as replacement of the fixing section 15 or replacement of the ID units 20, for example.

In this manner, in the image forming apparatus 1, since the opening angle θ of the apparatus cover 3 is set selectively, it is possible to facilitate an operation such as maintenance of the exposure heads 29 or replacement of the fixing section 15. As a result, it is possible to increase user-friendliness of the image forming apparatus 1.

Further, in the image forming apparatus 1, the exposure heads 29K and 29Y may be oriented in the same or almost the same direction, and the exposure heads 29M and 29C may be oriented in the same or almost the same direction. This allows, in the case where the opening angle θ is 40 degrees, for example, the user to perform maintenance of the two exposure heads 29K and 29Y together, as illustrated in FIG. 3C. Further, in the case where the opening angle θ is 50 degrees, for example, the user may be able to perform maintenance of the two exposure heads 29M and 29C together, as illustrated in FIG. 3D. Accordingly, in the image forming apparatus 1, it is possible to increase efficiency of a maintenance work, and it is therefore possible to increase the user-friendliness.

Example Effects

In the example embodiment described above, the orientations of the respective four exposure heads may be set in accordance with the opening angle of the apparatus cover. Therefore, it is possible to increase the user-friendliness.

Modification Example 1

In the foregoing example embodiment, the link member 31 may cause the coupling member 32 to slide in accordance with the opening angle θ of the apparatus cover 3. According to a modification example 1, the link member 31 may be devised, and the user may be thereby caused to feel vibration when the user sets the opening angle θ of the apparatus cover 3, for example, to 40 degrees and to 50 degrees. The modification example 1 will be described below in detail.

Figure 4:
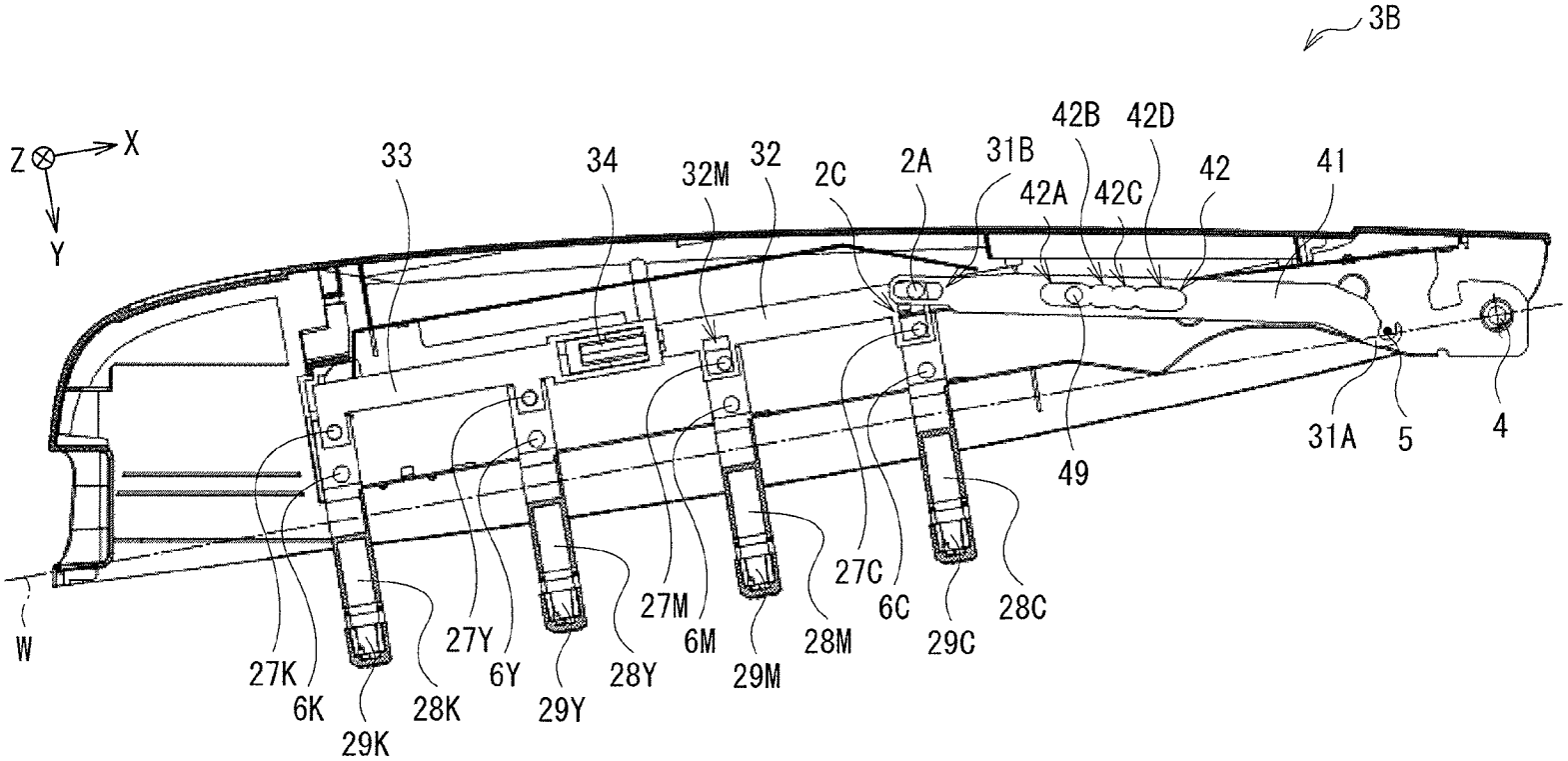
FIG. 4 is a structural diagram illustrating one configuration example of an apparatus cover according to a modification example.

FIG. 4 illustrates one configuration example of an apparatus cover 3B according to the modification example 1. The apparatus cover 3B may include a pin 49 and a link member 41. The pin 49 may be provided on an unillustrated link member that is pivotably coupled to the apparatus cover 3B, for example. The link member 41 may be configured to allow the coupling member 32 to move in accordance with the opening angle θ of the apparatus cover 3B. Unlike the link member 31 illustrated in FIG. 2 according to the foregoing example embodiment, the link member 41 may have a hole portion 42. The hole portion 42 may be configured to engage with the pin 49. The hole portion 42 may have a shape in which two or more hole portions are coupled to each other. In this example, the hole portion 42 may have a shape in which four hole portions 42A, 42B, 42C, and 42D are coupled to each other. The hole portions 42A, 42B, 42C, and 42D may be disposed in this order in the direction approaching the rotation fulcrum 4. In other words, three projections may be provided at an upper edge of the hole portion 42, and three projections may be provided at a lower edge of the hole portion 42. With this configuration, as the user lifts the apparatus cover 3B and as the opening angle θ of the apparatus cover 3B increases, for example, the position of the pin 49 in the hole portion 42 may move in the direction approaching the rotation fulcrum 4. In a specific but non-limiting example, the position of the pin 49 may move in the order of the hole portion 42A, the hole portion 42B, the hole portion 42C, and the hole portion 42D. Thereafter, each time the pin 49 comes into contact with the projections provided at the upper edge and the lower edge of the hole portion 42, the user may feel vibration. This may allow the user to sensorially grasp the opening angle θ of the apparatus cover 3B. The link member 41 may correspond to the "first member" in one specific but non-limiting embodiment of the technology. The pin 49 may correspond to a "fourth member" in one specific but non-limiting embodiment of the technology.

Figure 5A:
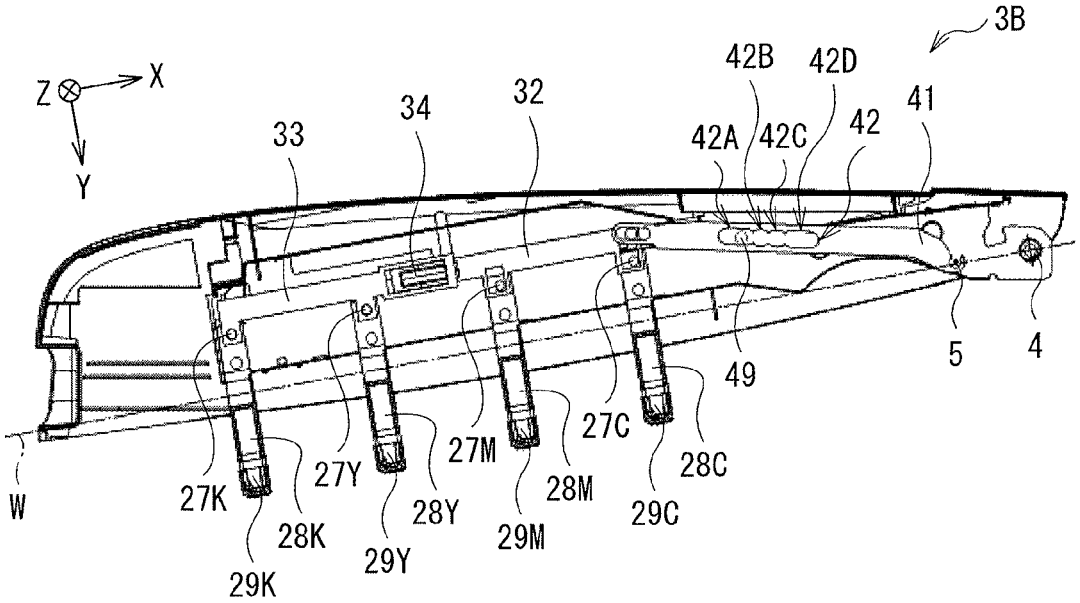
FIG. 5A is an explanatory diagram illustrating one operation example of an apparatus cover illustrated in FIG. 4.
Figure 5B:
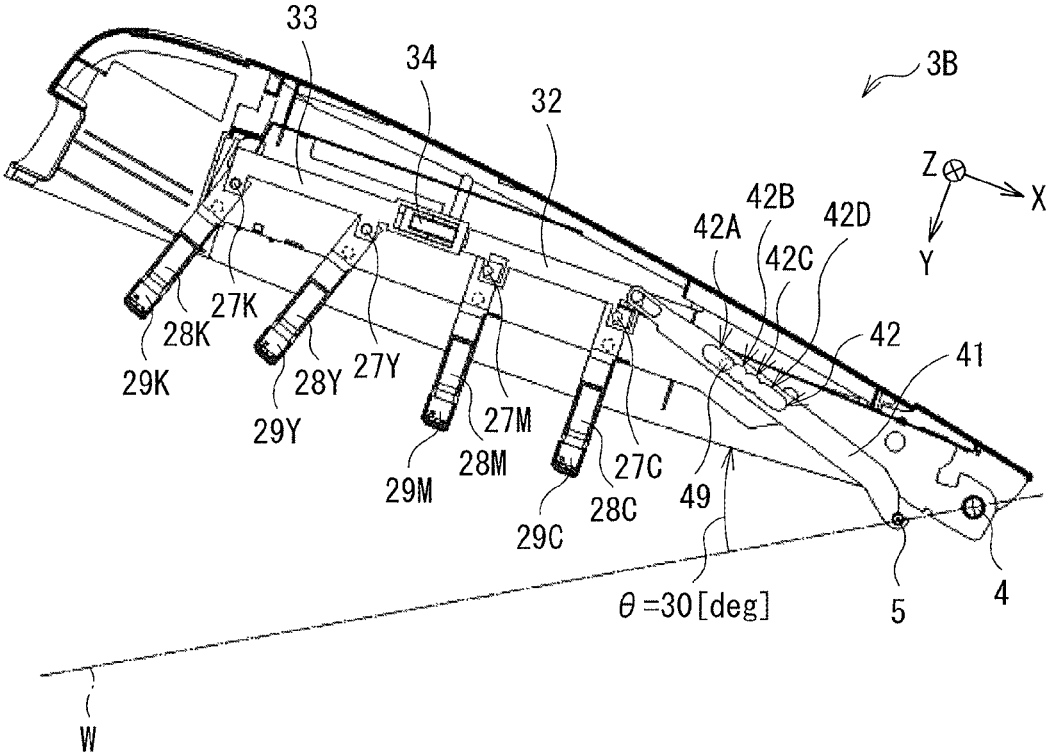
FIG. 5B is another explanatory diagram illustrating one operation example of the apparatus cover illustrated in FIG. 4.
Figure 5C:
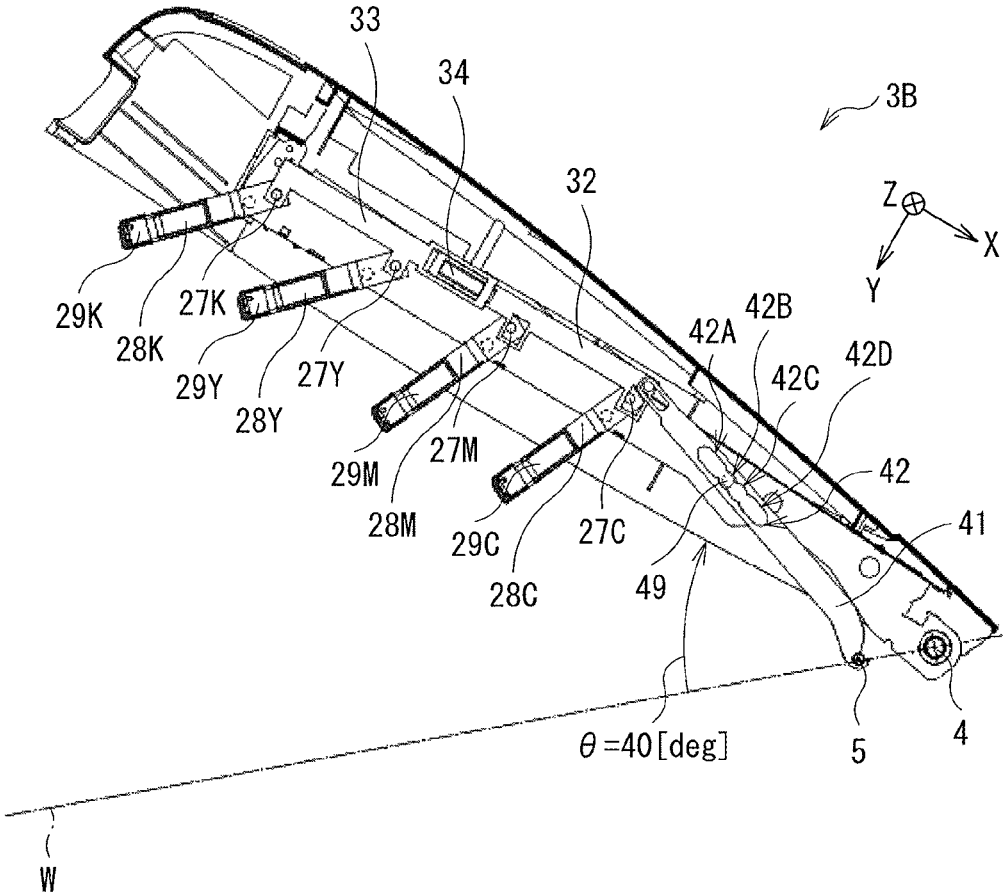
FIG. 5C is still another explanatory diagram illustrating one operation example of the apparatus cover illustrated in FIG. 4.
Figure 5D:
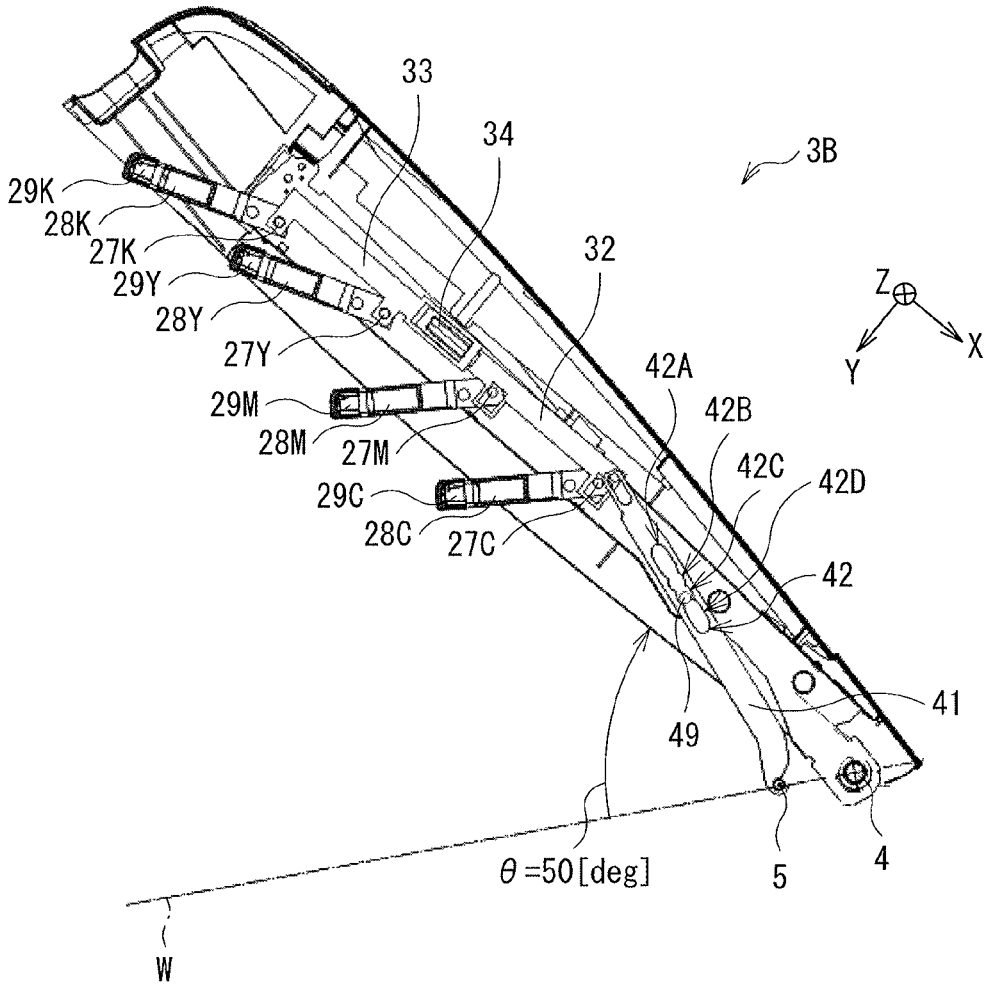
FIG. 5D is still another explanatory diagram illustrating one operation example of the apparatus cover illustrated in FIG. 4.
Figure 5E:
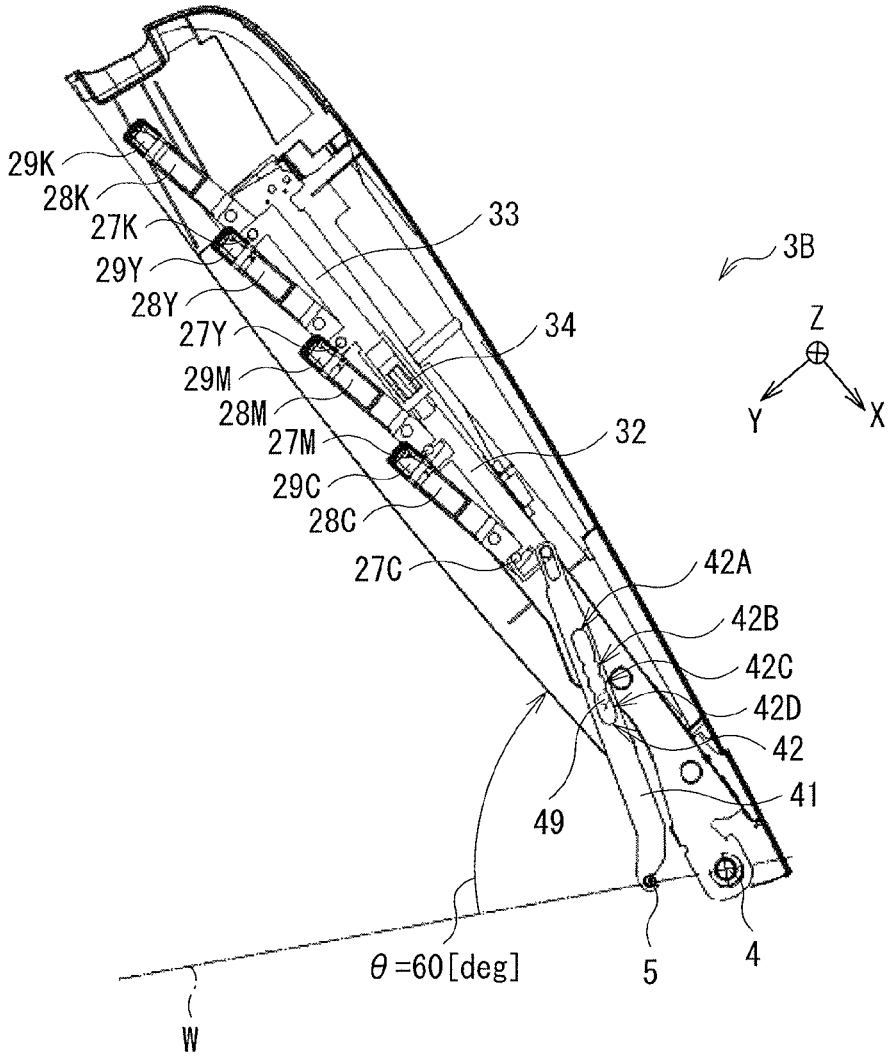
FIG. 5E is still another explanatory diagram illustrating one operation example of the apparatus cover illustrated in FIG. 4.

FIGS. 5A to 5E illustrate one operation example of the apparatus cover 3B. FIG. 5A illustrates a case where the opening angle θ is 0 (zero) degrees. FIG. 5B illustrates a case where the opening angle θ is 30 degrees. FIG. 5C illustrates a case where the opening angle θ is 40 degrees. FIG. 5D illustrates a case where the opening angle θ is 50 degrees. FIG. 5E illustrates a case where the opening angle θ is 60 degrees.

In the case where the opening angle θ is 0 (zero) degrees illustrated in FIG. 5A and in the case where the opening angle θ is 30 degrees illustrated in FIG. 5B, the pin 49 may be positioned in the hole portion 42A of the hole portion 42 of the link member 41.

Further, in the case where the opening angle θ is 40 degrees illustrated in FIG. 5C, the pin 49 may be positioned in the hole portion 42B of the hole portion 42 of the link member 41. In other words, when the opening angle θ varies from 30 degrees to 40 degrees, the pin 49 may come into contact with the projections provided at the upper edge and the lower edge of hole portion 42, and the user may thereby feel vibration. In the case where the opening angle θ is 40 degrees, as described above, the user may perform maintenance of the exposure heads 29K and 29Y more easily. The stated vibration may allow the user to sensorially grasp that the opening angle θ is at an angle that allows the user's easier access to the exposure heads 29K and 29Y for maintenance.

In a similar manner, in the case where the opening angle θ is 50 degrees illustrated in FIG. 5D, the pin 49 may be positioned in the hole portion 42C of the hole portion 42 of the link member 41. In other words, when the opening angle θ varies from 40 degrees to 50 degrees, the pin 49 may come into contact with the projections provided at the upper edge and the lower edge of hole portion 42, and the user may thereby feel vibration. In the case where the opening angle θ is 50 degrees, as described above, the user may perform maintenance of the exposure heads 29M and 29C more easily. The stated vibration may allow the user to sensorially grasp that the opening angle θ is at an angle that allows the user's easier access to the exposure heads 29M and 29C for maintenance.

In a similar manner, in the case where the opening angle θ is 60 degrees illustrated in FIG. 5E, the pin 49 may be positioned in the hole portion 42D of the hole portion 42 of the link member 41. In other words, when the opening angle θ varies from 50 degrees to 60 degrees, the pin 49 may come into contact with the projections provided at the upper edge and the lower edge of the hole portion 42, and the user may thereby feel vibration. In the case where the opening angle θ is 60 degrees, as described above, the user may replace a component such as the fixing section 15 or the ID units 20 more easily. The stated vibration may allow the user to sensorially grasp that the opening angle θ is at an angle that allows the user's easier access to the component such as the fixing section 15 or the ID units 20 for replacement.

Modification Example 2

In the foregoing example embodiment, the user may lift the apparatus cover 3; however, this is non-limiting. According to a modification example 2, a spring may be provided, and this spring may help the user with an operation of lifting the apparatus cover 3. The modification example 2 will be described below in detail.

Figure 6:
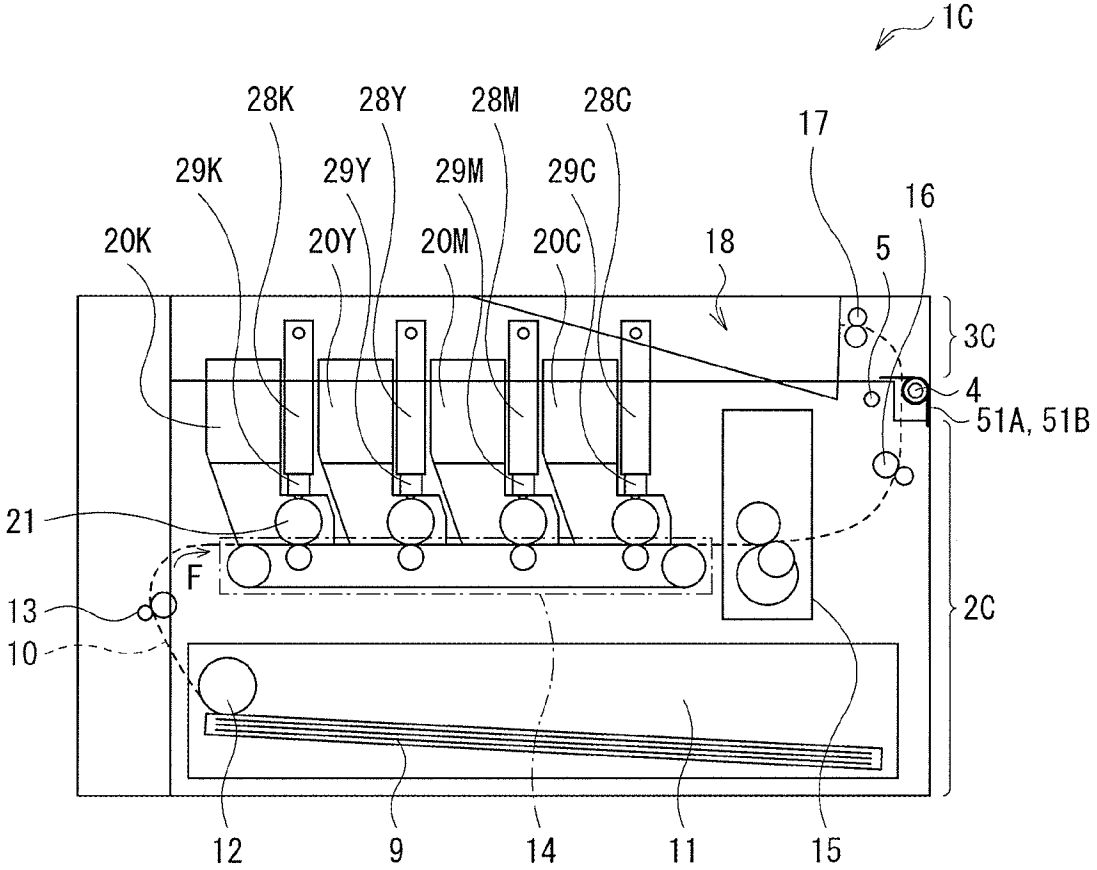
FIG. 6 is an explanatory diagram illustrating one configuration example of an image forming apparatus according to another modification example.

FIG. 6 illustrates one configuration example of an image forming apparatus IC according to the modification example 2. The image forming apparatus IC may include an apparatus body 2C, an apparatus cover 3C, and a plurality of springs 51. The springs 51 may include springs 51A and 51B. The springs 51 may each be a torsion spring, for example, and urge the apparatus cover 3C in a direction in which the apparatus cover 3C opens. An arm angle of the spring 51A and an arm angle of the spring 51B may differ from each other. In a specific but non-limiting example, the arm angle of the spring 51B may be set greater than the arm angle of the spring 51A. The spring 51B may correspond to an "urging member" in one specific but non-limiting embodiment of the technology.

Figure 7A:
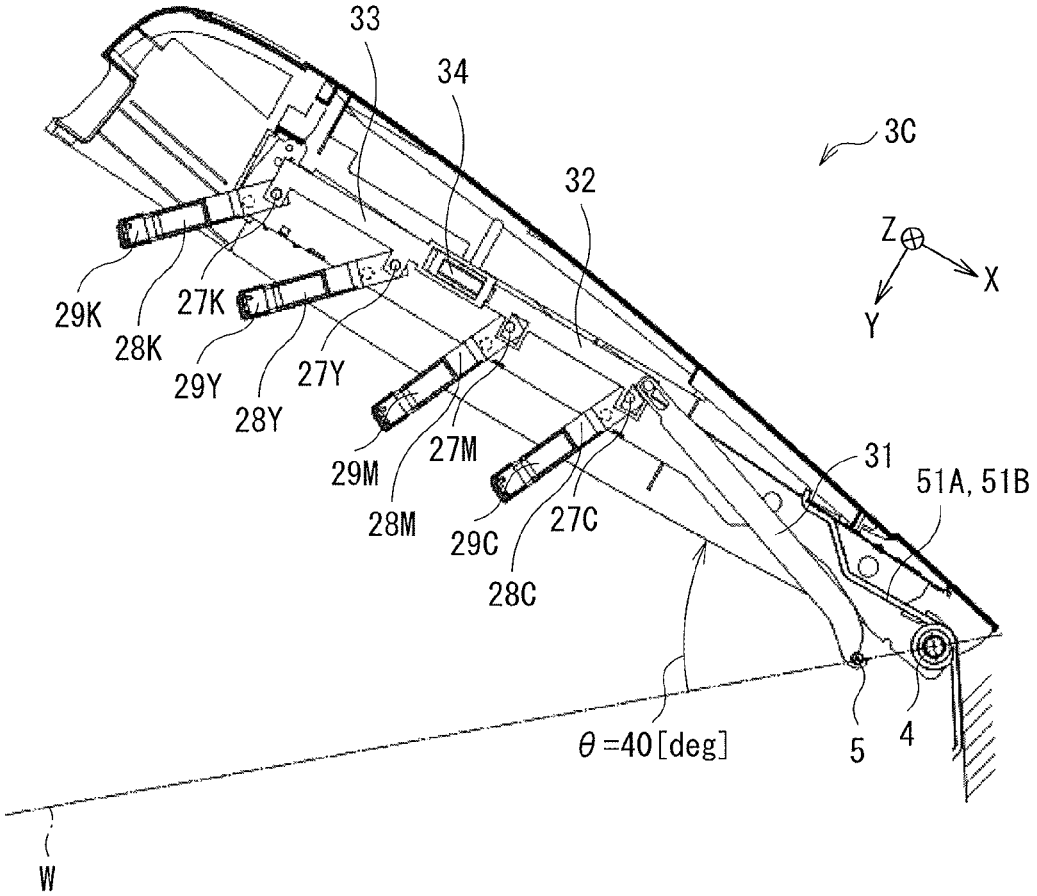
FIG. 7A is an explanatory diagram illustrating one operation example of an apparatus cover illustrated in FIG. 6.
Figure 7B:
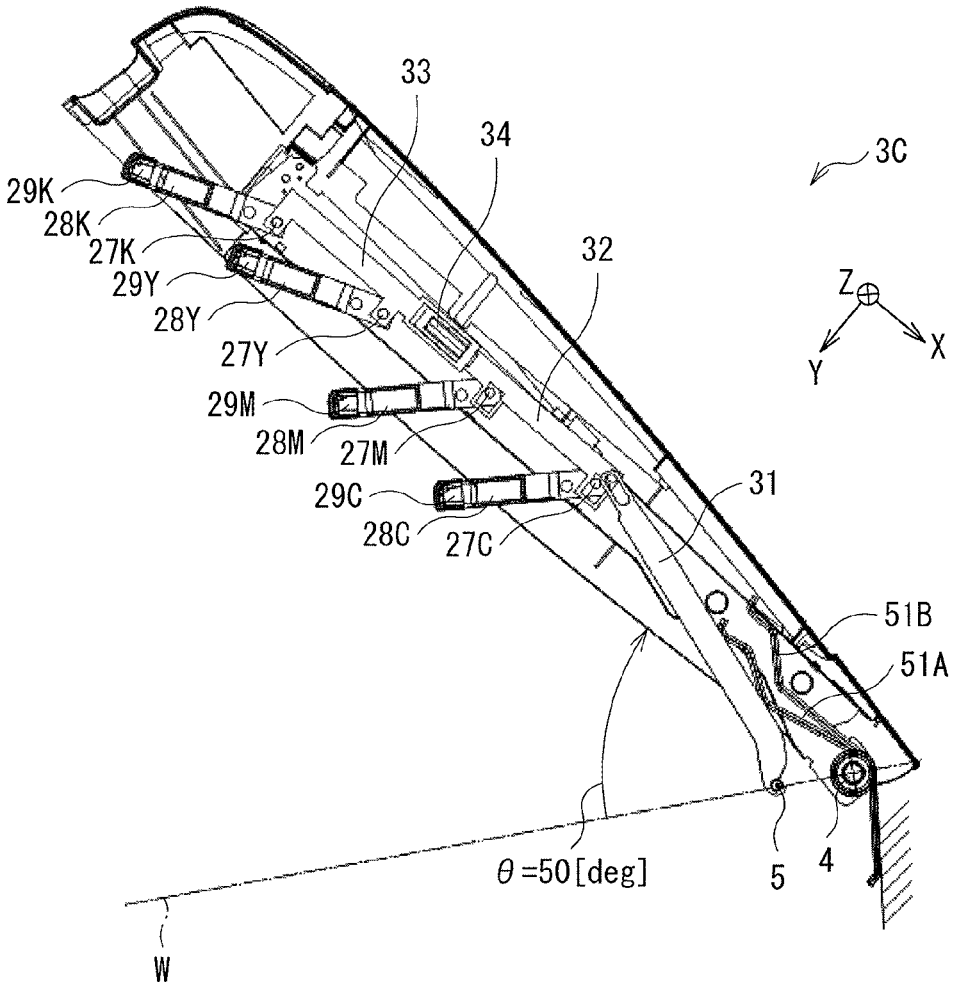
FIG. 7B is another explanatory diagram illustrating one operation example of the apparatus cover illustrated in FIG. 6.
Figure 7C:
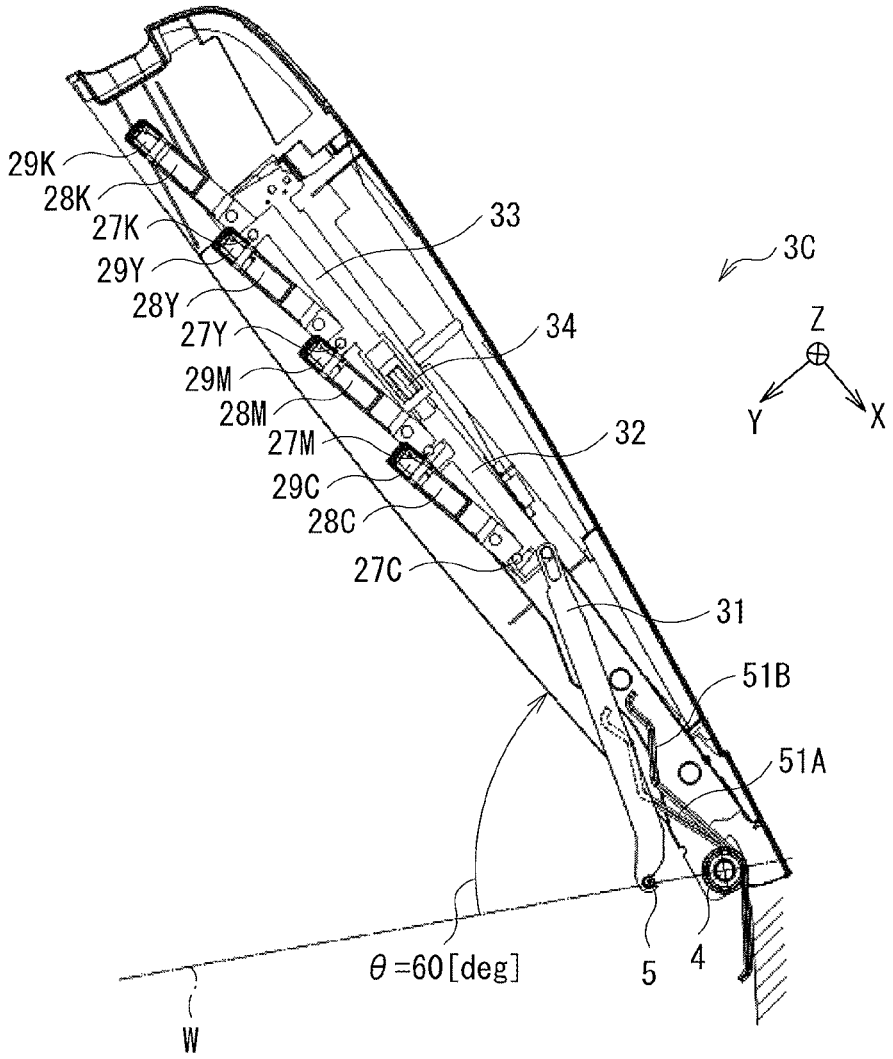
FIG. 7C is still another explanatory diagram illustrating one operation example of the apparatus cover illustrated in FIG. 6.

FIGS. 7A to 7C illustrate one operation example of the springs 51A and 51B. FIG. 7A illustrates a case where the opening angle θ is 40 degrees. FIG. 7B illustrates a case where the opening angle θ is 50 degrees. FIG. 7C illustrates a case where the opening angle θ is 60 degrees.

In this example, the spring 51A may urge the apparatus cover 3C while the opening angle θ is no greater than 40 degrees, and the spring 51B may urge the apparatus cover 3C while the opening angle θ is no greater than 50 degrees. In other words, in a case where the opening angle θ is no greater than 40 degrees, the springs 51A and 51B may both urge the apparatus cover 3C. In a case where the opening angle θ is greater than 40 degrees but no greater than 50 degrees, the spring 51B may urge the apparatus cover 3C. In a case where the opening angle θ is greater than 50 degrees, no urging force may act on the apparatus cover 3C.

The spring 51A may urge the apparatus cover 3C in a case where the opening angle θ is no greater than 40 degrees and refrain from urging the apparatus cover 3C in a case where the opening angle θ is greater than 40 degrees, for example. Therefore, in a case where the opening angle θ is around 40 degrees illustrated in FIG. 7A, the user may be able to feel variation in the urging force at this opening angle θ by lightly pressing down the apparatus cover 3C. In the case where the opening angle θ is 40 degrees, as described above, the user may perform maintenance of the exposure heads 29K and 29Y more easily. The stated variation in the urging force may allow the user to sensorially grasp that the opening angle θ is at an angle that allows the user's easier access to the exposure heads 29K and 29Y for maintenance.

Further, the spring 51B may urge the apparatus cover 3C in a case where the opening angle θ is no greater than 50 degrees and refrain from urging the apparatus cover 3C in a case where the opening angle θ is greater than 50 degrees, for example. Therefore, in the case where the opening angle θ is around 50 degrees illustrated in FIG. 7B, the user may be able to feel a change in the urging force at this opening angle θ by lightly pressing down the apparatus cover 3C. In the case where the opening angle θ is 50 degrees, as described above, the user may perform maintenance of the exposure heads 29M and 29C more easily. The stated variation in the urging force may allow the user to sensorially grasp that the opening angle θ is at an angle that allows the user's easier access to the exposure heads 29M and 29C for maintenance.

As the user further lifts the apparatus cover 3C, the user may be able to bring the opening angle θ to 60 degrees, as illustrated in FIG. 7C. This may allow the user to more easily perform an operation such as replacement of the fixing section 15 or replacement of the ID units 20, for example.

Although the two springs 51A and 51B are provided in this example, this is non-limiting. For example, three springs 51A, 51B, and 51C may be provided, and the spring 51C may urge the apparatus cover 3C irrespective of the opening angle θ. In this case, the apparatus cover 3C may be urged by the spring 51C until the apparatus cover 3C fully opens. Even in this case, the user may be able to feel variation in the urging force, for example, in the case where the opening angle θ is 40 degrees or in the case where the opening angle θ is 50 degrees by lightly pressing down the apparatus cover 3C.

Thus far, the technology has been described with reference to the example embodiment and the modification examples. The technology, however, is not limited to these example embodiment and modification examples, and various other modifications are possible.

For example, although four ID units may be provided in the foregoing example embodiment and modification examples, this is non-limiting. Alternatively, for example, three ID units may be provided, or five ID units may be provided.

For example, although the toner images formed by the ID units 20 may be directly transferred onto the recording medium 9 in the foregoing example embodiment and modification examples, this is non-limiting. Alternatively, for example, a toner image formed by an ID unit may be temporarily transferred onto an intermediate transfer belt, and the toner image transferred onto the intermediate transfer belt may be transferred onto a recording medium.

Furthermore, the technology encompasses any possible combination of some or all of the various embodiments and the modifications described herein and incorporated herein. It is possible to achieve at least the following configurations from the above-described example embodiments of the technology.

(1)

An image forming apparatus, including:

an apparatus cover that opens or closes by pivoting about a rotation fulcrum with respect to an apparatus body, the apparatus cover including an inner surface that opposes the apparatus body when the apparatus cover is in a closed state;

a first exposure unit disposed at a first position on the inner surface of the apparatus cover, the first position being spaced apart from the rotation fulcrum;

a second exposure unit disposed at a second position on the inner surface of the apparatus cover, the second position being closer than the first position to the rotation fulcrum; and an orientation setting mechanism provided on the inner surface of the apparatus cover, the orientation setting mechanism setting an orientation of the first exposure unit and an orientation of the second exposure unit in accordance with an opening angle of the apparatus cover, the orientation setting mechanism setting the orientation of the first exposure unit to a first direction approaching the apparatus body when the apparatus cover is in the closed state, the orientation setting mechanism setting the orientation of the first exposure unit to a second direction and setting the orientation of the second exposure unit to a third direction when the apparatus cover is open and the opening angle is a first angle, the second direction being a direction further away than the first direction from the rotation fulcrum, the third direction being a direction between the first direction and the second direction.

(2)

The image forming apparatus according to (1), in which the orientation setting mechanism sets the orientation of the second exposure unit to the second direction when the opening angle of the apparatus cover is a second angle greater than the first angle.

(3)

The image forming apparatus according to (1) or (2), in which the orientation setting mechanism sets the orientation of the first exposure unit to the third direction when the opening angle of the apparatus cover is a third angle smaller than the first angle.

(4)

The image forming apparatus according to any one of (1) to (3), further including a third exposure unit disposed at a third position on the inner surface of the apparatus cover, the third position being closer than the first position to the rotation fulcrum and farther than the second position from the rotation fulcrum, in which the orientation setting mechanism sets an orientation of the third exposure unit to one of the second direction and the third direction when the opening angle of the apparatus cover is the first angle.

(5)

The image forming apparatus according to any one of (1) to (4), in which the second direction is a direction in which the first exposure unit is retracted into the apparatus cover.

(6)

The image forming apparatus according to any one of (1) to (5), in which an opening is provided between the apparatus cover and the apparatus body as the apparatus cover opens, and the third direction is a direction approaching the opening.

(7)

The image forming apparatus according to any one of (1) to (6), further including an urging member that urges the apparatus cover and thereby increases the opening angle of the apparatus cover when the opening angle of the apparatus cover is no greater than the first angle.

(8)

The image forming apparatus according to (7), in which the urging member is a torsion spring provided at a position in proximity to the rotation fulcrum.

(9)

The image forming apparatus according to any one of (1) to (6), which the orientation setting mechanism includes a first member including a first end portion and a second end portion, the second end portion being coupled to the apparatus body and are pivotable about an auxiliary rotation fulcrum, a second member that engages with the first end portion of the first member, the second member being slidable in a predetermined sliding direction, the second member varying the orientation of the second exposure unit to a direction away from the rotation fulcrum by sliding in the sliding direction, an elastic member, and a third member coupled to the second member with the elastic member interposed therebetween, the third member being slidable in the sliding direction, the third member varying the orientation of the first exposure unit to a direction away from the rotation fulcrum by sliding in the sliding direction.

(10)

The image forming apparatus according to (9), in which the orientation setting mechanism further includes a first holding portion that holds the first exposure unit, the first holding portion including a first projection portion that engages with the third member, and a second holding portion that holds the second exposure unit, the second holding portion including a second projection portion that engages with the second member.

(11)

The image forming apparatus according to (10), in which the second member has a hole portion that engages with the second projection portion, and the hole portion is greater in size than the second projection portion.

(12)

The image forming apparatus according to any one of (9) to (11), in which the orientation setting mechanism includes a fourth member provided on the apparatus cover, the first member includes an edge portion allowed to come into contact with the fourth member, the edge portion includes one or more projections, and the fourth member comes into contact with the edge portion at a position corresponding to the opening angle of the apparatus cover.

With the image forming apparatus according to one embodiment of the technology, the orientation of the first exposure unit is set to the second direction further away than the first direction from the rotation fulcrum and the orientation of the second exposure unit is set to the third direction between the first direction and the second direction when the apparatus cover is open and the opening angle is the first angle. Accordingly, it is possible to increase user-friendliness.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus, comprising:

an apparatus cover that opens or closes by pivoting about a rotation fulcrum with respect to an apparatus body, the apparatus cover including an inner surface that opposes the apparatus body when the apparatus cover is in a closed state;

a first exposure unit disposed at a first position on the inner surface of the apparatus cover, the first position being spaced apart from the rotation fulcrum;

a second exposure unit disposed at a second position on the inner surface of the apparatus cover, the second position being closer than the first position to the rotation fulcrum; and an orientation setting mechanism provided on the inner surface of the apparatus cover, the orientation setting mechanism setting an orientation of the first exposure unit and an orientation of the second exposure unit in accordance with an opening angle of the apparatus cover, the orientation setting mechanism setting the orientation of the first exposure unit to a first direction approaching the apparatus body when the apparatus cover is in the closed state, the orientation setting mechanism setting the orientation of the first exposure unit to a second direction and setting the orientation of the second exposure unit to a third direction when the apparatus cover is open and the opening angle is a first angle, the second direction being a direction further away than the first direction from the rotation fulcrum, the third direction being a direction between the first direction and the second direction.

2. The image forming apparatus according to claim 1, wherein the orientation setting mechanism sets the orientation of the second exposure unit to the second direction when the opening angle of the apparatus cover is a second angle greater than the first angle.

3. The image forming apparatus according to claim 1, wherein the orientation setting mechanism sets the orientation of the first exposure unit to the third direction n e opening angle of the apparatus cover is a third angle smaller than the first angle.

4. The image forming apparatus according to claim 1, further comprising a third exposure unit disposed at a third position on the inner surface of the apparatus cover, the third position being closer than the first position to the rotation fulcrum and farther than the second position from the rotation fulcrum, wherein the orientation setting mechanism sets an orientation of the third exposure unit to one of the second direction and the third direction when the opening angle of the apparatus cover is the first angle.

5. The image forming apparatus according to claim 1, wherein the second direction is a direction in which the first exposure unit is retracted into the apparatus cover.

6. The image forming apparatus according to claim 1, wherein an opening is provided between the apparatus cover and the apparatus body as the apparatus cover opens, and the third direction is a direction approaching the opening.

7. The image forming apparatus according to claim 1, further comprising an urging member that urges the apparatus cover and thereby increases the opening angle of the apparatus cover when the opening angle of the apparatus cover is no greater than the first angle.

8. The image forming apparatus according to claim 7, wherein the urging member is a torsion spring provided at a position in proximity to the rotation fulcrum.

9. The image forming apparatus according to claim 1, wherein the orientation setting mechanism includes a first member that includes a first end portion and a second end portion and is pivotable about an auxiliary rotation fulcrum, the second end portion being coupled to the apparatus body, a second member that engages with the first end portion of the first member, the second member being slidable in a predetermined sliding direction, the second member varying the orientation of the second exposure unit to a direction away from the rotation fulcrum by sliding in the sliding direction, an elastic member, and a third member coupled to the second member with the elastic member interposed therebetween, the third member being slidable in the sliding direction, the third member varying the orientation of the first exposure unit to a direction away from the rotation fulcrum by sliding in the sliding direction.

10. The image forming apparatus according to claim 9, wherein the orientation setting mechanism further includes a first holding portion that holds the first exposure unit, the first olding portion including a first projection portion that engages with the third member, and a second holding portion that holds the second exposure unit, the second holding portion including a second projection portion that engages with the second member.

11. The image forming apparatus according to claim 10, wherein the second member has a hole portion that engages with the second projection portion, and the hole portion is greater in size than the second projection portion.

12. The image forming apparatus according to claim 9, wherein the orientation setting mechanism includes a fourth member provided on the apparatus cover, the first member includes an edge portion allowed to come into contact with the fourth member, the edge portion includes one or more projections, and the fourth member comes into contact with one of the one or more projections of the edge portion, the one of the one or more projections corresponding to the opening angle of the apparatus cover.

* * * * *